United States Patent [19]

Hampel

[11] Patent Number: 4,469,565

[45] Date of Patent: Sep. 4, 1984

[54] PROCESS OF CONTINUOUSLY ELECTRODEPOSITING ON STRIP METAL ON ONE OR BOTH SIDES

[75] Inventor: Josef Hampel, Breitenfurt, Austria

[73] Assignee: Andritz-Ruthner Industrieanlagen Aktiengesellschaft, Vienna, Austria

[21] Appl. No.: 520,328

[22] Filed: Aug. 4, 1983

[30] Foreign Application Priority Data

Aug. 5, 1982 [AT] Austria ..... 3014/82
Jul. 4, 1983 [AT] Austria ..... 2438/83

[51] Int. Cl.[3] ..... C25D 5/02; C25D 5/08
[52] U.S. Cl. ..... 204/15; 204/28; 204/206
[58] Field of Search ..... 204/15, 206, 28

[56] References Cited

U.S. PATENT DOCUMENTS

| | | | |
|---|---|---|---|
| 3,692,640 | 9/1972 | Hamabe | 204/206 |
| 4,310,403 | 1/1982 | Nitto | 204/206 |
| 4,313,802 | 2/1982 | Shibuya | 204/43 Z |
| 4,367,125 | 1/1983 | Avellone | 204/206 |
| 4,397,727 | 8/1983 | Degen | 204/206 |

*Primary Examiner*—Thomas Tufariello
*Attorney, Agent, or Firm*—Fleit, Jacobson, Cohn & Price

[57] ABSTRACT

In a process of continuously electrodepositing a metal layer on one or both sides of strip metal which moved while it is maintained in a non-horizontal direction, the electrolyte flows between at least one platelike anode and the strip metal which constitutes a cathode. The electrode flows downwardly by gravity and in the space between the anode and the strip metal forms a coherent body of flowing liquid. Additional electrolyte is continuously supplied to said space.

11 Claims, 19 Drawing Figures

Figure 4F:
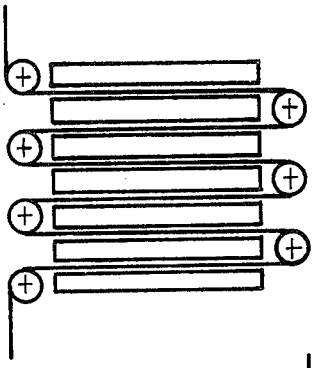

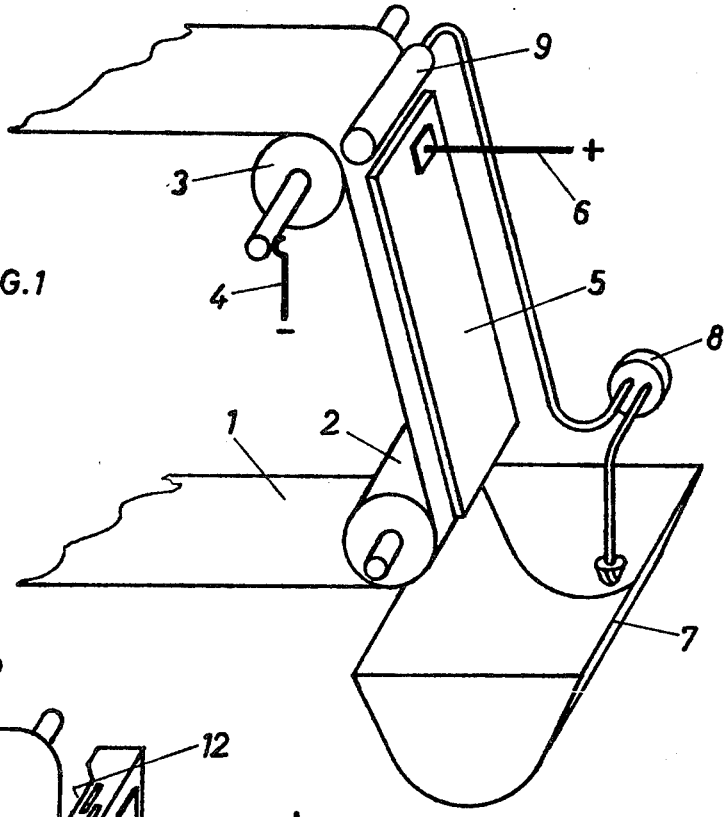
FIG. 1
FIG. 2
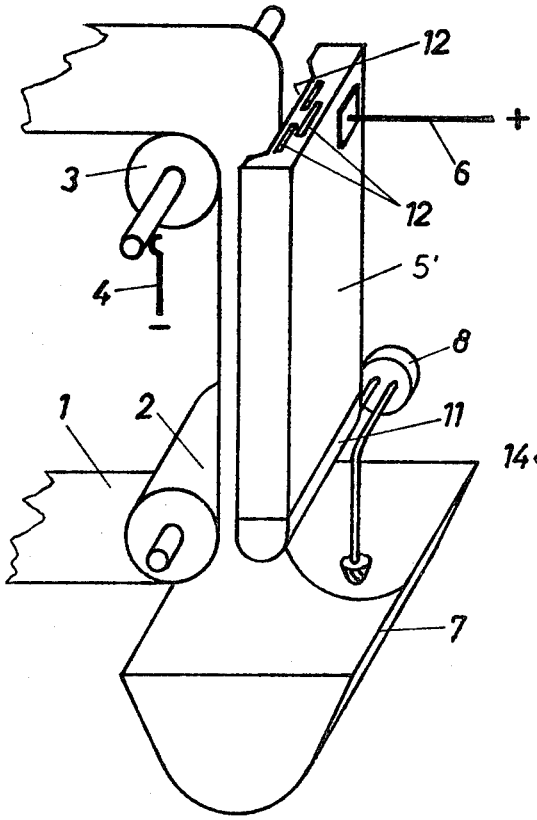
FIG. 3
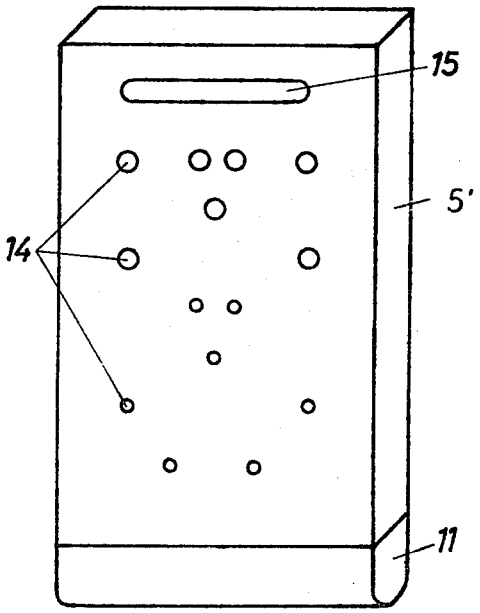

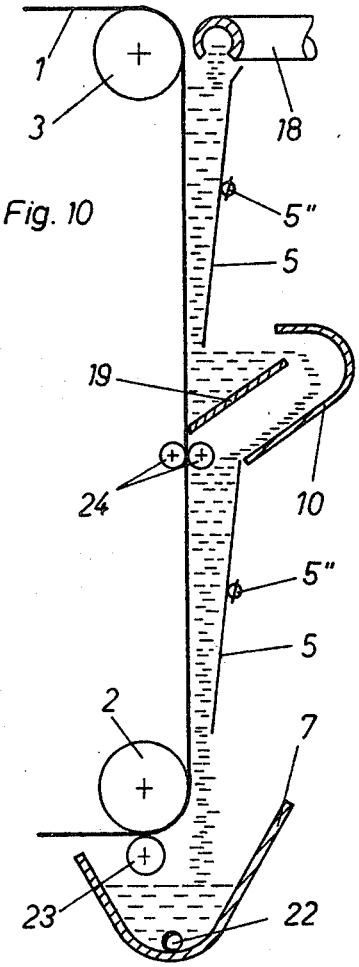
Fig. 10
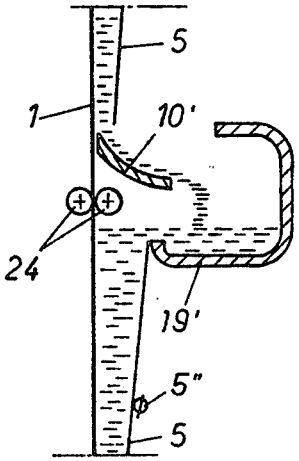
Fig. 11
Fig. 12
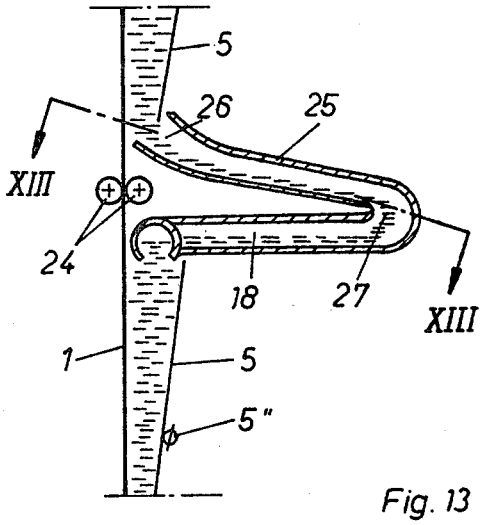
Fig. 13
Fig. 14
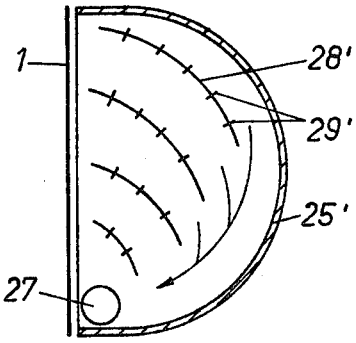
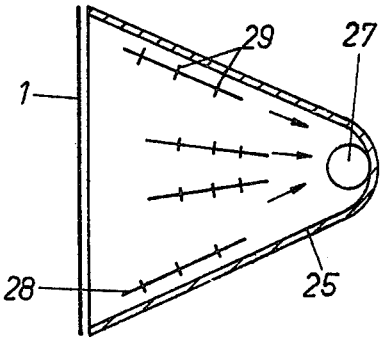

PROCESS OF CONTINUOUSLY ELECTRODEPOSITING ON STRIP METAL ON ONE OR BOTH SIDES

SUMMARY OF INVENTION

A process of continuously electrodepositing on strip metal on one or both sides. The strip metal is moved while it is maintained in a non-horizontal orientation. The electrolyte flows between at least one platelike anode and the strip metal, which constitutes a cathode. The electrode flows freely from a vessel in the upper region of the anode into the space between the anode and the strip metal and flows downwardly by gravity as a coherent body of flowing liquid.

This invention relates to a process of continuously electrodepositing a metal layer on one or both sides of strip metal, which is moved while it is maintained in a non-horizontal orientation. The electrolyte flows between at least one platelike anode and the strip metal, which constitutes a cathode.

Such process can be used to deposit a metal consisting of zinc, tin, brass or the like on one side of strip metal. The process can also be developed so that deposits can be applied to both sides of the strip metal in one pass and such deposits may differ in thickness.

In the known processes used for that purpose, the strip metal was usually submerged in the electrolyte so that the electrolyte connected the strip on both sides unless this was prevented by special precautions. For this reason the deposition of metal only on one side involved great difficulties even if specially designed anode arrays and masks were employed. It was never possible to prevent in a satisfactory manner an electrodeposition of metal on a small marginal area on the rear of the metal strip and the deposits obtained had an undesirably higher thickness near the edges. These disadvantages cannot entirely be avoided even when the strip is caused to contact the periphery of a roller, which is submerged in the electrolyte and causes the strip to be moved past an anode so as to effect electrodeposition. This is due to the fact that owing to the stress gradients resulting from the rolling of the strip, the latter often exhibits a certain waviness at its edges so that even when the strip is in snug contact with the roller in other regions the electrolyte can flow around said wavy edges to the rear of the strip and owing to the throwing power of the electrolyte will then cause an electrodeposition to be effected on a larger area on the rear of the strip.

The concept underlying the invention resides in that, different from the usual practice, the strip and the anode are no longer submerged into the electrolyte but a hydrodynamic contact between the electrolyte, on the one hand, and the strip and the anode, on the other hand, is maintained by a continuous supply of additional electrolyte.

In accordance with the invention the electrolyte is permitted to flow freely in the upper region of the anode and under the action of gravity flows downwardly to form in the space between the anode and the strip metal a coherent body of flowing liquid, and additional electrolyte is continuously supplied to said space. This operation ensures an intense bath motion on the surfaces of the electrode because the electrolyte flows downwardly almost in a free fall.

In accordance with another feature of the invention the metal strip is inclined from the vertical by such an angle that the coherent body of flowing liquid consisting of the electrolyte flowing downwardly in the space between the anode and the metal strip is maintained, and the distance between the anode and the metal strip amounts to 2 to 20 mm, preferably 10 mm. It may be desirable, e.g., if the current density is high, to compensate small voltage drops along the anode (in the direction from the terminal) in that the distance between the strip metal and the anode is somewhat smaller at the end which is remote from the current supply terminal.

It has been found that the angle between the strip metal and the vertical may be up to 30° C.

Regarding the manner in which additional electrolyte is supplied to the space between the anode and the strip metal, a preferred embodiment of the process resides in that part of the additional electrolyte which is supplied to the space between the anode and strip metal may enter said space at the top of the anode, e.g., across an overflow weir, or from a slotted vessel or the like means, so that the electrolyte flows down from there throughout the length of the anode into a collecting vessel.

In another embodiment of the invention, at least part of the additional electrolyte which is supplied to the space between the anode and the strip mmetal enters said space through a plurality of bores or slots, which extend through the anode. It will be understood that the two embodiments described last may be combined.

Certain difficulties will be encountered when very high current densities are employed for a deposition on strips moving at high speed in high-duty plants. For mechanical and electrochemical reasons and in order to dissipate heat generated by the Joule effect, the rate at which electrolyte is supplied and the distance between the strip metal and the anode must be increased correspondingly. As a result, the influences which are due to the adhesion of electrolyte to the metallic surfaces and to the viscosity of the electrolyte decrease and the downward flow of the electrolyte approaches a free fall.

This results not only in a steep rise of the rate at which electrolyte flows through the cell but also in an increasing difference between the velocities of flow of the electrolyte in the upper and lower portions of the cell so that the cross-sectional area which is required by the electrolyte, which cross-sectional area is reciprocal to the average velocity, changes along the anode.

This problem can be solved in accordance with the invention in that the distance between the anode and the strip metal is constant or decreases in the direction of flow of the electrolyte.

It has been found that it will be desirable to provide between the strip metal and the anode a distance which decreases continuously in the downward direction.

An arrangement which is desirable from the aspect of flow dynamics will be obtained if the distance between the strip metal and the anode decreases downwardly in accordance with the equation $d=k\sqrt{Vs}$, wherein d is the distance, s the length of the path to the downward flow of the electrolyte, and k a constant.

A further improvement provided by the invention resides in that the distance between the top edge of the anode and the strip metal and the distance between the bottom edge of the anode and the strip metal are adjusted independently of each other.

Another requirement is to increase the capacity of the plant even when the floor space is very small and to accomplish this without a very large increase in costs.

The anode may be increased in length in the direction in which the strip is moved. But that increase is limited for various reasons: the anodes have only a limited current-carrying capacity and the terminal for supplying the current to one point of the anode is bulky and involves a complicated arrangement for dissipating heat; the heavy anodes give rise to structural problems owing to their heavy weight, etc., and anodes of excessive length will give rise to additional hydrodynamic problems. On the other hand, the strip may be moved up and down in a length of ten or twenty meters or more. It has been found that a surprisingly simple and desirable arrangement can be obtained in accordance with the invention in that at least two anodes are arranged one over the other near the metal strip and the electrolyte flowing into the uppermost anode is collected under each anode and then flows freely into the next lower anode.

In the process embodiments described herinbefore, electrodes may be provided in known manner on both sides of the strip metal for a deposition on one or both sides.

It has been found that in arrangements comprising electrodes disposed on both sides of the strip metal, it is most desirable to separately select the polarity, the voltage and the current. This will permit a deposition in different thicknesses on the two sides of the strip and a cathodic connection of the electrodes on one side of the strip. This will afford the advantage that the strip can be cleaned or roughened or the like on the side on which no metal is to be deposited. Such actions are known to be desirable for the further processing of the strip, e.g., by painting, soldering, and the like operations. Finally, the strip may be anodically oxidized, e.g., on one side and coated with a metal by cathodic electrodeposition on the other side.

In an alternative embodiment, electrodes are provided on both sides of the strip metal, voltage is applied only to one of the electrodes, which constitutes an anode, and the electrode is supplied only to the space between that anode and the strip metal.

In another embodiment, the strip metal is coated on one or both sides and the strip metal is moved in alternating directions relative to the direction of flow of the electrolyte adjacent to consecutive anodes so that the strip metal is moved co-currently and countercurrently relative to the electrolyte in alternation. This practice results in a rapid motion of the bath on the surface of the strip so that the electrodeposition will be promoted.

In another embodiment, the strip metal is wetted by the electrolyte under currentless conditions, preferably by being sprayed with or immersed into the electrolyte, in order to improve the growth of the nuclei.

In a special embodiment of the invention, a zinc-nickel alloy is deposited on strip steel, the direction of movement of the strip steel relative to the direction of flow of the electrolyte changes once or several times, and electrodeposition is effected with a current density of 20 to 150 amperes per square decimeter, preferably 40 to 100 amperes per square decimeter, by means of an electrolyte which consists of an aqueous solution at a temperature of 40° to 70° C., preferably 45° to 60° C., and contains at least 80 g/l $NiSO_4.7H_2O$, at least 150 g/l $ZnSO_4.7H_2O$ and 2 g/l $H_3BO_3$ in concentrations up to their respective solubilities in said solution.

In that process a nickel-zinc ratio between 4:10 and 10:10, preferably between 5:10 and 8:10 is maintained in the electrolyte so that the electrodeposited layer contains 8 to 15 wt.% nickel, preferably 9 to 13 wt.% nickel. Within the scope of the invention a process may be carried out in which an acid sulfate electrolyte is used, which contains no chloride ions from which chlorine would be liberated if insoluble anodes were employed. It is known to use sulfate electrolyte for an electrodeposition of alternating layers of zinc and nickel or of layers having low and high nickel contents so that the resistance of the resulting coatings to corrosion will be reduced. For instance, U.S. Pat. No. 4,313,802 describes a process in which the strip metal moves countercurrently to a pure sulfate electrolyte containing zinc and nickel in a ratio between 10:15 and 10:40 but with current densities of only 5 to 40 amperes per square decimeter. The high normality of the nickel results in correspondingly high losses of entrained nickel. It has also been proposed to add strontium sulfate as a brightener in quantities of 0.05 to 10 g/l but that practice also involves disadvantages because strontium sulfate has an extremely low solubility and is relatively expensive.

In said process according to the invention it has been found to be desirable to maintain in the bath a pH value of 1 to 2, preferably of 1.3 to 1.8, by a periodic or continuous addition of sulfuric acid, to use in known manner insoluble anodes consisting, e.g., of lead-silver or electrode carbon, and to make up for the extraction of metal in that metal oxides, metal hydroxides, or metal carbonates are dissolved or in that the metals or metal alloys themselves are chemically and/or anodically dissolved.

Sulfates, borates, boric acid ($H_3BO_3$), aminosulfonic acid ($NH_2SO_3H$), formic acid (HCOOH), acetic acid ($CH_3COOH$) as well as glucose and their salts may be admixed in addition to sulfuric acid.

Apparatus for carrying out the process consists of at least two deflecting rollers which in a manner known per se are arranged one over the other, at least one insoluble anode, which deviates from the horizontal and is substantially parallel to the strip metal, terminals for supplying electric current to the anode and to the cathode, which consists of the strip metal that is trained around the rollers, drive means for moving the strip, at least one container for collecting the electrolyte, at least one pump for circulating the electrolyte, and pipelines for supplying the electrolyte to the space between the anode and the strip metal.

In one embodiment of that apparatus a device for supplying electrolyte comprises an elongated vessel, which is disposed at the top of the anode and is continuously supplied with electrolyte, e.g., by a pump for circulating electrolyte, and is disposed over the space between the anode and the strip metal and has one or more slots through which the electrolyte is continuously supplied from above into the space between the anode and the strip metal.

In another embodiment, the anode is formed with a plurality of through bores of through slots, a vessel is provided, one wall of which is consituted by the apertured wall of the anode, and pipelines lead from the pump to said vessel and serve to effect a continuous supply of electrolyte to said vessel.

The last-mentioned two embodiments of the apparatus may be combined with each other. Alternatively, the means for supplying electrolyte at the top of the anode may comprise a single aperture formed in the anode near its top edge, and a pipe for supplying electrolyte, which pipe is connected to the rear of the anode.

Numerous advantages are afforded by the process according to the invention and by the apparatus for carrying out the process. For instance, the wetting of the strip metal can be interrupted by a simple de-energization of the electrolyte pump even if the electrolyte has a high acidity. This ensures that an etching of the strip metal and the like effects will be prevented even when the strip metal is at a standstill for prolonged times. Besides, the distance between the strip metal and the anode may be extremely small and in most cases may be much smaller than the 20 mm which have been stated as a limit. This is due to the fact that the rapid downward flow of the elctrolyte under the action of gravity ensures a rapid flow of electrolyte at the boundary layers so that the latter will always be very thin and only very low concentration polarizations may be developed at the electrodes. The heat which is generated in the case of high current densities will be rapdily dissipated and any gas bubbles which may be formed and which may reduce the wetted electrode surface will also be removed quickly. For this reason, the terminal voltages and the electric power may be low so that the power losses which are due to the heating of the bath by the Joule effect will be extremely low and the highest possible current density will be very high. This permits a particularly economical and compact design. An important advantage resides in that the strip metal is wetted only on its forward side by the electrolyte so that even a slight electrodeposition on the rear side of the strip metal will be prevented. The body of flowing liquid which fills the space between the electrodes is abruptly constricted and torn apart by dynamic action at the edge of the strip so that there is virtually no or no appreciable increase in current density at the edge of the strip and, as a result, there is no need for masks. For this reason, even strips which camber, i.e., which are laterally deflected as they pass through the cells, can readily be used, provided that the anodes are sufficiently wide.

If metal is to be dissolved in the electrolyte in order to maintain the concentration of metal ions, this can be accomplished by means of chemical or anodic dissolving cells, which are known per se.

The process according to the invention and the apparatus will now be described with reference to some illustrative embodiments which are shown in the drawings, in which FIGS. 1 and 2, respectively, are perspective views showing two embodiments of the apparatus, FIG. 3 is a perspective view showing a detail of the apparatus, FIGS. 4*a* to 4*f* and 5*a* to 5*d* are simplified side elevations showing different ways in which a plurality of electrolytic cells according to the application can be arranged in one and the same strip-plating plant.

Figure 6:
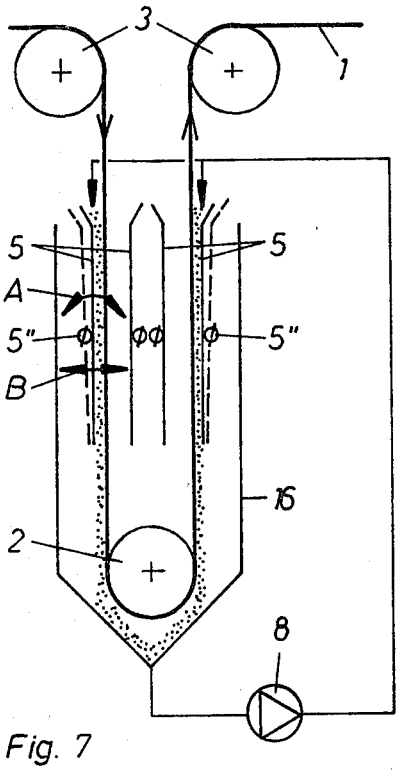
Figure 8:
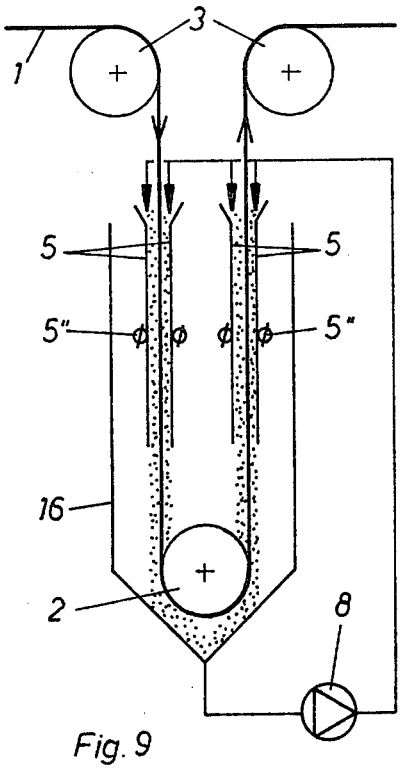
Figure 7:
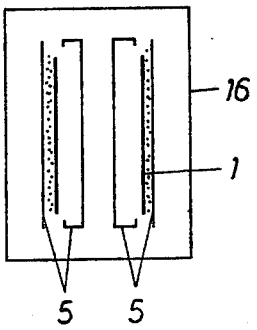
Figure 9:
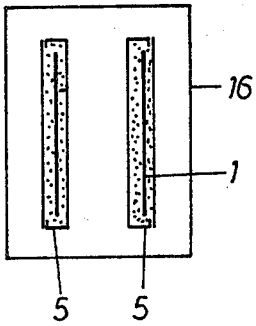
Figure 17:
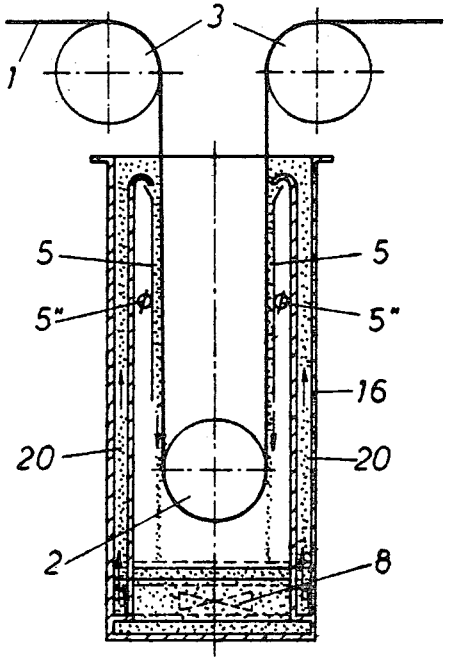
Figure 15:
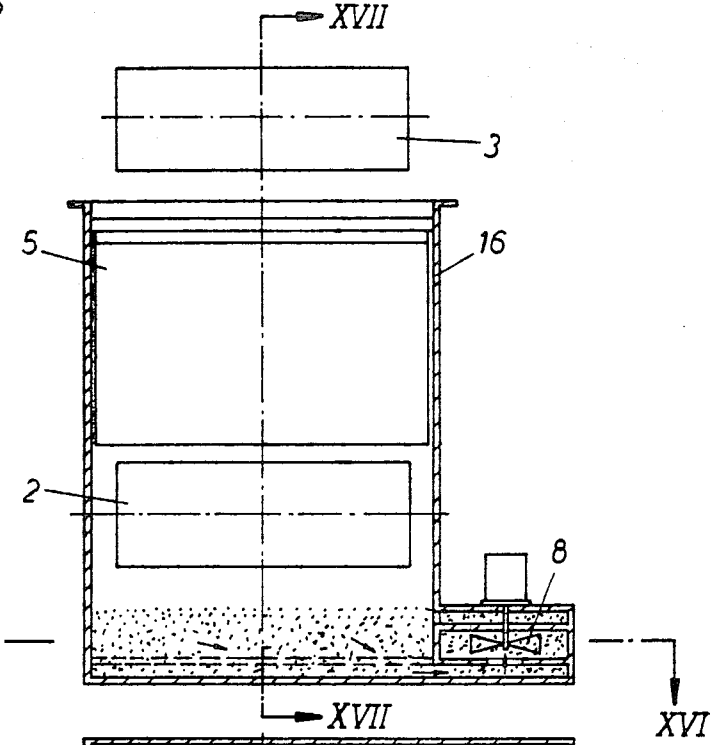
Figure 16:
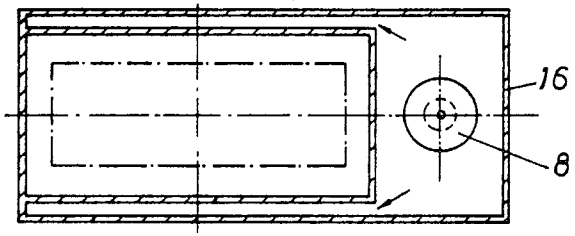

FIG. 6 is a simplified transverse sectional view showing apparatus according to the invention for plating strip metal on one side, FIG. 7 is a top plan view showing the apparatus of FIG. 6, FIG. 8 shows the apparatus of FIG. 6 used to plate strip metal on both sides, FIG. 9 is a top plan view showing the apparatus of FIG. 8, FIG. 10 is a transverse sectional view showing apparatus according to the invention for coating the strip metal on both sides; in that apparatus two anodes are arranged one over the other;

FIGS. 11 and 12 are top plan views showing two illustrative embodiments of means for collecting and redirecting the electrolyte, FIG. 13 is a sectional view taken on lines XIII—XIII in FIG. 12, FIG. 14 is a sectional view which is similar to FIG. 13 and shows different collecting and redirecting means, FIG. 15 is a transverse sectional view showing a further embodiment of apparatus according to the invention, FIG. 16 is a sectional view taken on lines XVI—XVI in FIG. 15, and FIG. 17 is a sectional view taken on lines XVII—XVII in FIG. 15.

In the plant shown in FIG. 1, a strip metal 1 is continuously pulled in an upward or downward direction around the deflecting rollers 2, 3 in an inclined orientation past an anode 5, which is also inclined. By means of current supply terminals 4, 6, a predetermined potential or a predetermined current between the anode 5 and the strip metal 1 is maintained. To permit that flow of current and the resulting electrodeposition of a metal layer on that side of the strip metal which faces the anode, electrolyte is continuously supplied by means of a pump 8 from the electrolyte-collecting vessel 7 via a pipeline to a vessel 9, which has a longitudinal slot, through which the electrolyte flows continuously into the space between the strip metal 1 and the anode 5. The electrolyte fills that space and in said space flows dowonwardly and then enters the collecting vessel.

In FIG. 2 the strip metal 1 and the anode 5' have a vertical orientation and the anode consists of a box having a compartment 11, to which the electrolyte is fed by a pump 8. The electrolyte rises uniformly to the top portion of the box and by through slots 12 and an overflow 13 provided on the wall which faces the strip 1 flows on different levels into the space between the anode box 5' and the strip metal 1. From that space the electrolyte flows back to the collecting vessel 7. FIG. 3 shows an anode box 5', which is closed at its top and is provided with bores 14, which in accordance with the different hydrostatic pressures are larger and more closely spaced apart in the upper portion and smaller and more widely spaced apart in the lower portion of the box 5'. An overflow is consituted by a wide slot 15 disposed above the bores 14.

In order to permit an electrodeposition on both sides of the strip, possibly in different thicknesses, and in order to permit the design of a plant of adequate capacity, it is desirable to provide a plurality of the electrolytic cells described hereinbefore one beside the other and/or one over the other adjacent to the path along which a single strip is pulled through the plant.

Figure 4E:
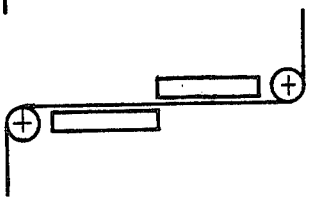
Figure 4D:
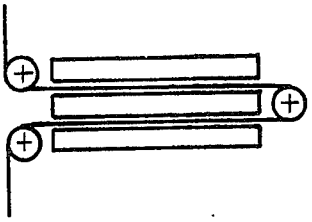
Figure 4C:
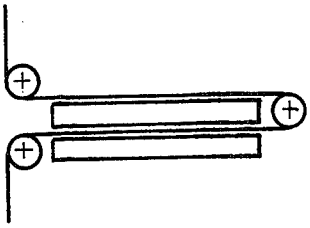
Figure 4B:
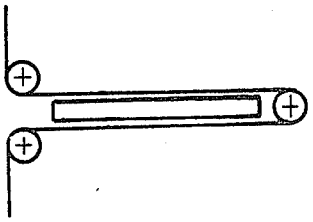
Figure 4A:
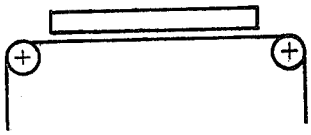

Some embodiments of this concept are shown in FIGS. 4*a* to 4*f* with the strip and the anode in a vertical orientation and in FIGS. 5*a* to 5*d* with the strip and the anode in an inclined orientation. The embodiment shown in FIG. 4*a* comprises a box-shaped anode. FIG. 4*b* shows an embodiment in which one and the same side of the strip is moved twice (in upward and downward directions) past the same anode box so that the effective anode surface area of said box can be doubled if the box is provided with bores or slots and an overflow in two mutually opposite walls. In accordance with FIG. 4*c*, another, unilateral anode box may be provided on the other side of the strip so that a plant is obtained which is particularly suitable for a deposition of metal layers differing greatly in thickness on the two sides of the strip. That plant may be extended by the provision of another anode, as is shown in FIG. 4*d*, so that the same anode surface area is available for each side of the strip. Superimposed anodes are shown in FIG. 4*e*. FIG. 4*f* shows a densely packed arrangement of anode boxes, most of which are effective on both sides, in a high-duty plant.

The use of inclined electrodes as shown in FIGS. 5*a* to 5*d* permits a reduction of the height of the plant. Besides, hydrostatic and hydrodynamic effects can be utilized which are related to the inclined position.

Figure 5D:
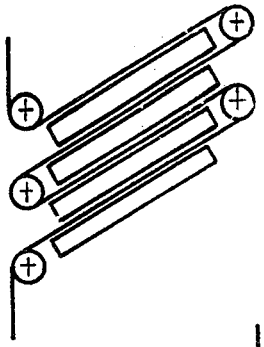
Figure 5C:
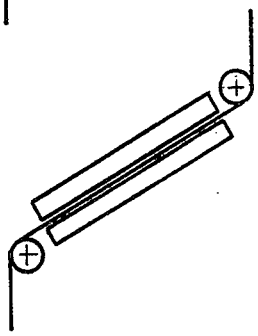
Figure 5B:
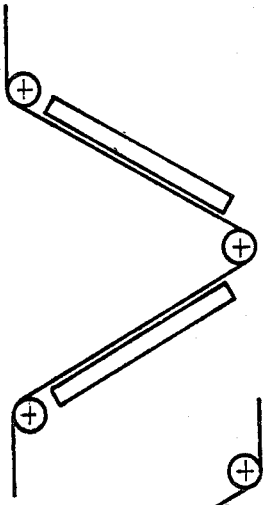
Figure 5A:
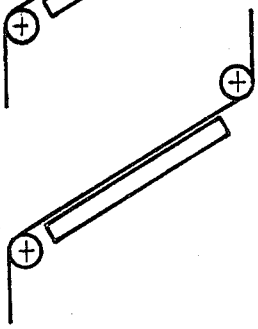

The arrangement shown in FIGS. 5*a* and 5*b* serves for an electrodeposition on one side. The arrangement shown in FIGS. 5*c* and 5*d* may be used for an electrodeposition on both sides.

FIG. 6 shows a metal strip 1, which is trained around two upper deflecting roller 3 and one lower deflecting roller 2. The upper deflecting roller 3 are provided with current supply terminals (not shown). Anodes 5 are provided on both sides of the metal strip 1 and each of them is connected to a carrier 5''. As is indicated by arrows A, B, the carrier 5'' is mounted to be adjustable about the horizontal axis (arrow A) and as regards its distance from the strip metal 1 (arrow B). In the embodiment shown by way of example the carrier 5'' is connected to the anode 5 preferably at the center of the anode. From the dotted lines which indicate the anodes 5 it is apparent that the distance from each anode to the strip metal and the inclination of each anode to the strip metal can be adjusted as desired. In a preferred embodiment of the invention the carrier 5'' is electrically conducting and has an insulated mounting and is provided with current supply terminals (not shown). The anodes 5 and the deflecting roller 2 are provided within a cell casing 16. The electrolyte flowing out of the anodes 5 is collected on the bottom of a cell and is raised by a pump 8 to the upper portion or edge of the anodes 5 to complete the cycle. As is apparent from FIGS. 6 and 7 the strip metal is plated only on one side. For this reason the electrolyte is supplied only to the outer anodes 5, which are provided between the strip metal 1 and the wall of the cell 16.

In the embodiment shown in FIGS. 8 and 9, the strip metal is plated on both sides. For this purpose the electrolyte is supplied to all anodes 5. It is apparent from FIGS. 7 and 9 that the inner anodes 5 are provided at their edges with lateral extensions so that in the embodiment shown in FIGS. 8 and 9 the strip metal 1 is entirely surrounded by the anodes and the electrolyte cannot flow out laterally.

In another embodiment of the invention (not shown), the anode is connected to carriers at its top and bottom edges. These carriers are mutually independently adjustable as regards the distance of the anode from the strip metal 1. At least one carrier is electrically conducting and has an insulated mounting and is provided with current supply terminals.

Also in accordance with the invention that surface of each anode 5 which faces the strip metal 1 is planar or convexly curved toward the strip metal. The curvature may be in accordance with the equation $d=k\sqrt{Vs}$, wherein d is the distance between the strip metal 1 and the anode 5, s is the length of the path of the downward flow of the electrolyte, and k is a constant.

In the embodiment of the invention shown in FIG. 10, two anodes 5 are disposed one over the other. It will be understood that more than two anodes may be disposed one over the other. The electrolyte flows freely from a slot in a supply line 18 into the upper anode 5 and emerges from the latter to flow into a collecting tub 19. When that collecting tub 19 has been filled with electrolyte, the latter will flow out over the rim of the collecting tub 19 and will be collected by a redirecting tub 10 and subsequently be supplied to the lower anode and will freely flow into the latter. The electrolyte flowing out of the lower anode 5 is collected in a collecting vessel 7, which is provided with a drain 22. The electrolyte leaving the collecting vessel 7 is pumped to the supply line 18 by a pump, not shown. The residual electrolyte which adheres to the strip metal 1 is removed by a squeeze-off roller 23 and then flows off also to the collecting vessel 7.

To improve the distribution of current, additional rollers 24 are provided for a supply of current. Each of these rollers 24 is disposed between two adjacent anodes 5.

In the embodiment shown in FIG. 11, the electrolyte emerging from the upper anode 5 is deflected by a redirecting tub 10' to a collecting tub 19', from which the electrolyte flows over the rim of the collecting tub 19' into the space between the lower anode 5 and the strip metal 1.

The embodiment shown in FIG. 12 comprises an arrangement for collecting and redirecting the electrolyte. That arrangement comprises a shallow collecting funnel 25, the larger opening 26 of which receives the electrolyte from the upper anode 5 and from the smaller opening 27 of which the electrolyte flows through a pipe to the lower anode 5. The collecting funnel 25 contains guide webs 28 and baffle webs 29. These webs ensure that the electrolyte will be guided toward the smaller opening and that its flow will be retarded.

The modified collecting funnel 25' shown in FIG. 14 is semicircular and also provided with guide webs 28' and baffle webs 29'.

In the practical embodiment of the invention shown in FIGS. 15 to 17, a pump 8 is structurally integrated with the cell 16. Those parts which are identical to parts shown in FIG. 6 are provided with the same reference characters. As in the example shown in FIG. 6, two upper deflecting rollers 3 and a lower deflecting roller 2 are provided. The anodes 5 are again disposed in the space between the upper deflecting roller 3 and the lower deflecting roller 2. The anodes 5 and the lower deflecting roller 2 on one side or on both sides of the strip metal 1 are surrounded by an open-topped cell casing 16, at the bottom of which the electrolyte is collected. The electrolyte is subsequently pumped by the pump 8 to the anodes through laterally disposed passages provided on the cell casing. The pump 8 is disposed on the side of the cell casing on the level of the bottom of that casing. The side walls of the cell casing 16 are double-walled to define the laterally disposed passages 20. The bottom part of the cell casing 16 is connected by lines to a station, not shown, for dissolving the electrolyte.

What is claimed is:

1. A process of continuously electrodepositing a metal layer on at least one side of a strip metal which is moved while it is maintained in a non-horizontal orientation, comprising the steps of causing an electrolyte to flow between at least one platelike anode and the strip metal, which constitutes a cathode, permitting the electrode to enter freely adjacent to the upper portion of said anode to flow downwardly by gravity so that the electrolyte constitutes a coherent body of flowing liquid in the space between the anode and the strip metal and in contact with said strip metal, and continuously supplying additional electrolyte to said space to maintain said space filled with electrolyte.

2. A process as set forth in claim 1, wherein the angle between the strip metal and the vertical is up to 30° and the distance between the anode and the strip metal is 2 to 20 mm.

3. A process as set forth in claim 1, wherein there is no increase of the distance between the anode and the strip metal in the direction of flow of the electrolyte.

4. A process as set forth in claim 3, wherein the distance between the strip metal and the anode decreases downwardly in accordance with the equation $d=k\sqrt{Vs}$, wherein d is the distance between the strip metal and the anode, s is the length of the path for the downward flow of the electrolyte, and k is a constant.

5. A process according to claim 1, characterized in that electrodes are provided on both sides of the strip metal and the polarity of and the voltage applied to said electrodes are separately selected.

6. A process according to claim 1, characterized in that for electrodepositing a zinc-nickel alloy on a steel strip the relation of the direction of movement of the steel strip to the direction of flow of the electrolyte is reversed at least once, the electrodeposition is effected with a current density of 20 to 150 amperes per square decimeter by means of an electrolyte, which consists of an aqueous solution at 40° to 70° C. and contains at least 80 g/l $NiSO_4.7H_2O$, 150 g/l $ZnSO_4.7H_2O$ and 2 g/l $H_3BO_3$ in concentrations up to their respective solubilities in said solution.

7. A process according to claim 1, characterized in that a nickel-zinc ratio between 4:10 and 10:10 is maintained in said electrolyte to deposit a layer which contains 8 to 15 wt.% nickel, preferably 9 to 13 wt.% nickel.

8. A process according to claim 1, characterized in that a pH value of 1 to 2 is maintained in the bath by small additions of sulfuric acid.

9. A process according to claim 1, characterized in that at least part of the additional electrolyte supplied to the space between the anode and the strip metal is caused to enter said space through openings extending through the anode.

10. A process as set forth in claim 1, wherein at least two superimposed anodes are provided adjacent to the strip metal and the electrolyte entering an upper anode is collected under said anode and then permitted to flow freely into the next lower anode.

11. A process as set forth in claim 1, characterized in that the lower deflecting roller and at least a part of the electrodes are arranged in an open-topped cell, from which a pump conducts up the electrolyte to the anode through passages being out of the cell casing.

* * * * *

UNITED STATES PATENT AND TRADEMARK OFFICE

CERTIFICATE OF CORRECTION

PATENT NO. : 4,469,565

DATED : September 4, 1984

INVENTOR(S) : Hampel

It is certified that error appears in the above-identified patent and that said Letters Patent is hereby corrected as shown below:

In the Abstract, line 6, please delete "electrode" and insert in place thereof --electrolyte--.

In the Abstract, line 8, please delete "Additional" and insert in place thereof --The--.

Col. 1, line 12, please delete "electrode" and insert in place thereof --electrolyte--.

Col. 1, lines 62 and 63, please delete "additional".

Col. 2, line 12, please delete "30°C" and insert in place thereof --30°--.

Col. 2, line 13, please delete "additional".

Col. 2, line 16, please delete "that part" and insert in place thereof --that at least part--.

Col. 2, line 16, please delete "additional".

Col. 2, line 24, please delete "additional".

Col. 2, line 60, please delete "V".

Col. 3, line 43, please delete "electrode" and insert in place thereof --electrolyte--.

Col. 4, line 60, please delete "bores of" and insert in place thereof --bores or--.

Col. 7, line 63, please delete "V".

UNITED STATES PATENT AND TRADEMARK OFFICE

CERTIFICATE OF CORRECTION

PATENT NO. : 4,469,565

DATED : September 4, 1984

INVENTOR(S) : Hampel

It is certified that error appears in the above-identified patent and that said Letters Patent is hereby corrected as shown below:

Col. 8, lines 67 and 68 please delete "electrode" and insert in place thereof --electrolyte--.

Col. 9, line 17, please delete "V".

Signed and Sealed this

*Fifth* Day of *August 1986*

[SEAL]

*Attest:*

DONALD J. QUIGG

*Attesting Officer*

*Commissioner of Patents and Trademarks*